US005475883A

United States Patent [19]

Martin

[11] Patent Number: 5,475,883

[45] Date of Patent: Dec. 19, 1995

[54] WAVE GENERATING APPARATUS FOR WATERBEDS

[76] Inventor: Mary R. Martin, 325 Mohawk St., Rome, N.Y. 13440-6028

[21] Appl. No.: 344,971

[22] Filed: Nov. 25, 1994

[51] Int. Cl.[6] ..... A47C 27/08; A61H 1/00

[52] U.S. Cl. ..... 5/451; 5/916

[58] Field of Search ..... 5/451, 916, 108, 5/109, 400, 917; 601/148, 149

[56] References Cited

U.S. PATENT DOCUMENTS

| | | | |
|---|---|---|---|
| 3,872,526 | 3/1975 | Betts | 5/916 |
| 4,141,096 | 2/1979 | Hale et al. | 5/108 |
| 4,187,568 | 2/1980 | McMullan et al. | 5/916 |
| 4,231,126 | 11/1980 | Hurkett | 5/451 |
| 4,370,602 | 1/1983 | Jones, Jr. et al. | 318/114 |
| 4,639,959 | 2/1987 | Roca | 5/451 |
| 4,667,358 | 5/1987 | Penterman | 5/508 |

*Primary Examiner*—Alexander Grosz
*Attorney, Agent, or Firm*—Sean F. Sullivan; Henry S. Miller; Rhodes & Ascolillo

[57] ABSTRACT

A wave generating device for waterbeds, including an undulation mechanism for producing a first wave motion on a mattress of a waterbed, with the first wave motion including a repetitive, upward force which is orthogonal to a bottom surface of the mattress. A vibration mechanism produces a second wave motion on the mattress of the waterbed, with the second wave motion including repetitive, lateral forces in substantially the same plane as the bottom surface of the mattress. There is a control mechanism for adjustably controlling the speed of both the undulation and, vibration mechanisms, along with a housing mechanism for containing them. Finally, there is a securing mechanism for attaching the housing mechanism to an underside surface of a mattress supporting platform in the waterbed, and wiring for electrically connecting the control mechanism to the housing mechanism.

7 Claims, 4 Drawing Sheets

WAVE GENERATING APPARATUS FOR WATERBEDS

BACKGROUND OF THE INVENTION

1. Field of the Invention

The present invention relates generally to a waterbed wave generating device and, more particularly, to a device positioned underneath the frame of a water bed which produces both vibrating and wave generating motion on the water filled mattress.

2. Description of the Related Art

U.S. Pat. No. 4,141,096 issued to H. Hale and J. Taylor on Feb. 27, 1979 relates to a device for imparting wave motion, to the mattress of a waterbed, accomplished by providing a cutout triangular section in the bed frame underneath the mattress. The triangular section is upwardly lifted and then lowered with a motor-driven crank and arm assembly.

U.S. Pat. No. 4,231,126 issued to E. Hurkett on Nov. 4, 1980 discloses a water bed wave generator including a housing externally mounted on the outside of the bed frame. A vertically disposed pad extends from the housing and provides a downwardly directed force on the top of the mattress in order to produce the desired wave motion.

U.S. Pat. No. 4,370,602 issued to J. Jones, Jr. on Jan. 25, 1983 discloses an electronic vibrating mechanism for waterbeds having two separate vibration sources. The circuits are designed to generate two different frequencies in order to produce interference waves within the mattress.

U.S. Pat. No. 4,639,959 issued to A. Roca on Feb. 3, 1987 relates to a wave generator for waterbeds including a paddle unit for positioning on the horizontal mattress supporting surface of the bed frame. A pivoted arm supports the paddle and is reciprocated by an electric motor and accompanying linkages.

Finally, U.S. Pat. No. 4,667,358 issued to D. Penterman on May 26, 1987 discloses a solenoid operated device for providing undulating motion on a waterbed mattress. The solenoid is mounted on a supporting flange in such a manner that the output shaft of the solenoid contacts the mattress at an acute angle.

Individuals who own and sleep on waterbeds generally enjoy sensations caused by the subtle movement of water within the mattress. In most cases, this movement is caused by the user as he or she shifts position while relaxing or sleeping. However, many of these users also desire the relaxing motion of the mattress while remaining stationary during sleep, or in an attempt to fall asleep. To this end, there is somewhat of a need for devices which produce this waterbed motion without the need for the user to move around himself or herself.

Presently, there exist several devices which provide an external source of wave motion on a waterbed mattress, as is discussed above. Some of these devices are externally mounted on the frame of the waterbed, either at the head or the foot of the bed, taking up valuable sleeping space. Others provide only a single source and type of wave motion, requiring mechanical adjustments to vary the amplitude and frequency of the wave motion.

SUMMARY OF THE INVENTION

Accordingly, it is a principal object of the present invention to provide a device for introducing wave motion to the mattress of a waterbed which is easy to install and which does not mount on the outside of the bed frame, taking up space.

It is a further object of the invention to provide such a device which provides at least two different types of wave motion on the mattress, both of which are adjustably controlled by a panel conveniently located on the outside wall of the bed frame.

It is still a further object of the present invention to provide the device with protections from electrical shock and other safety hazards.

The present invention achieves the above objects, among others, by providing in one aspect a wave generating device for waterbeds, including an undulation mechanism for producing a first wave motion on a mattress of a waterbed, with the first wave motion including a repetitive, upward force which is orthogonal to a bottom surface of the mattress. A vibration mechanism produces a second wave motion on the mattress of the waterbed, with the second wave motion including repetitive, lateral forces in substantially the same plane as the bottom surface of the mattress. There is a control mechanism for adjustably controlling the speed of both the undulation and vibration mechanisms, along with a housing mechanism for containing them. Finally, there is a securing mechanism for attaching the housing mechanism to an underside surface of a mattress supporting platform in the waterbed, and wiring for electrically connecting the control mechanism to the housing mechanism.

Preferably, the undulation mechanism further includes an electric motor stationed within the housing mechanism and an eccentric camming member connected to an output shaft of the motor. A first rod mechanism has a first end to which a guide wheel is attached, with the guide wheel riding atop the outer edge of the camming member, while a first agitation pad is attached to a second end of the first rod mechanism, with the first agitation pad being in direct contact with the mattress.

The vibration mechanism further includes a vibration producing mechanism stationed within the housing. A second rod mechanism has a first end attached to the vibration producing mechanism, while a second agitation pad is attached to a second end of the second rod mechanism, with the second agitation pad being in direct contact with the mattress.

These and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
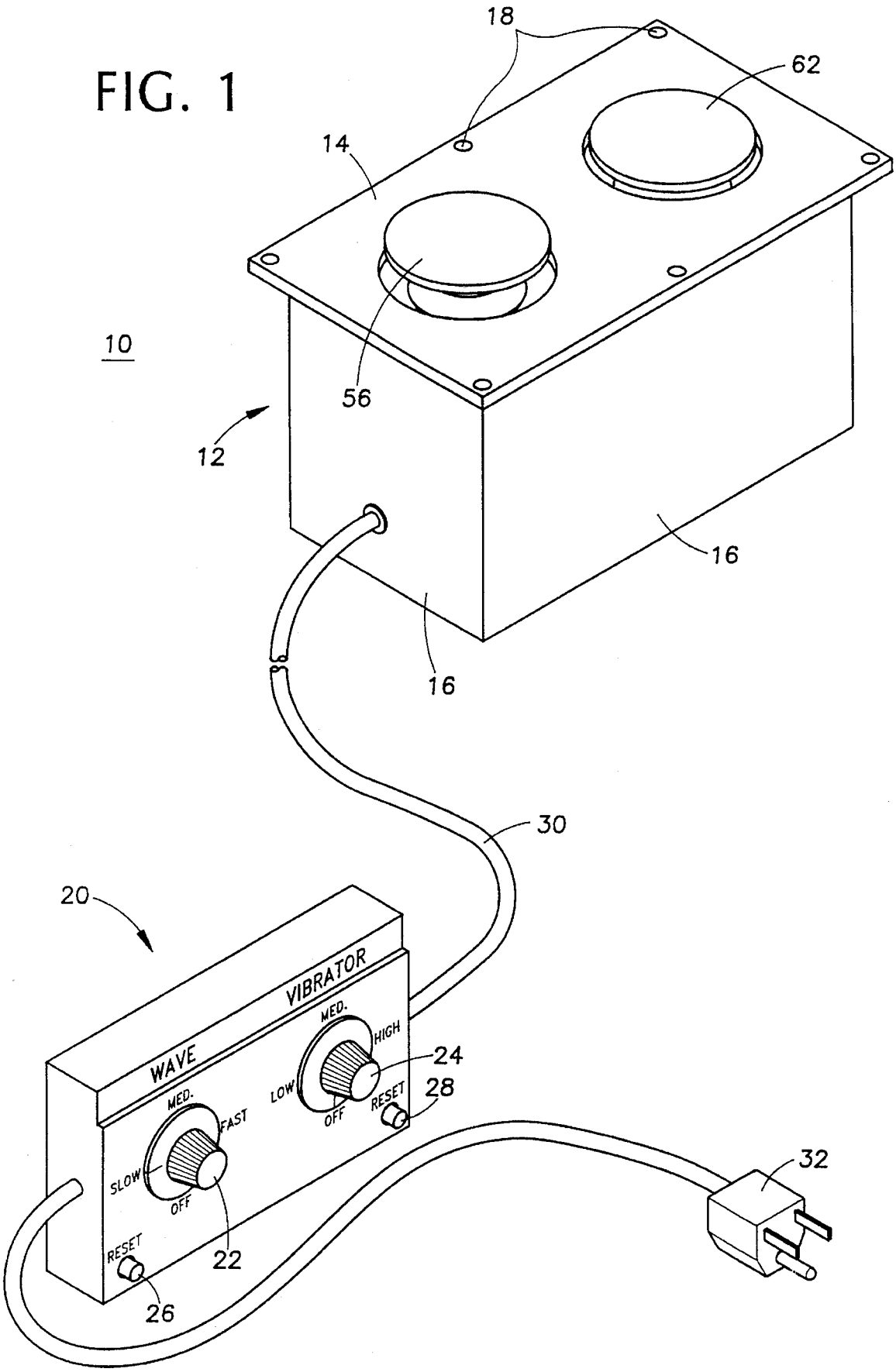
FIG. 1 is a perspective view of a wave generating device and control panel for waterbeds according to the present invention.
Figure 2:
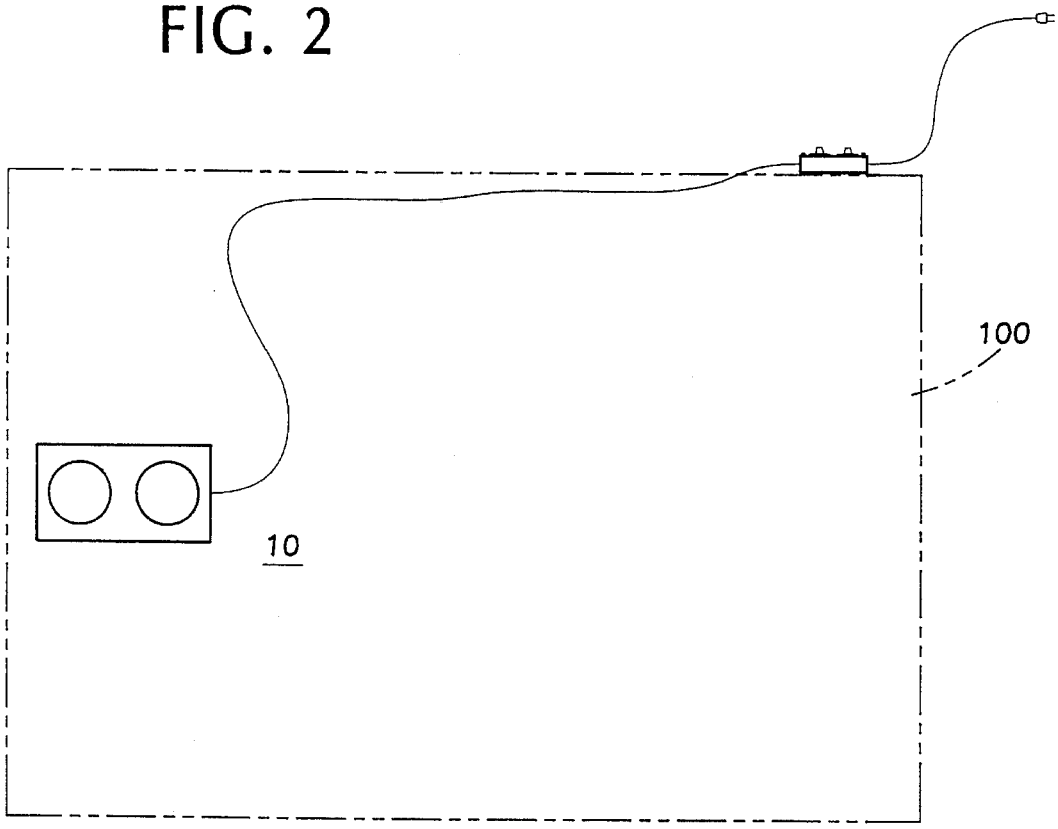
FIG. 2 is a plan view of the wave generating device and control panel illustrating their relative positions with respect to a waterbed frame.
Figure 3:
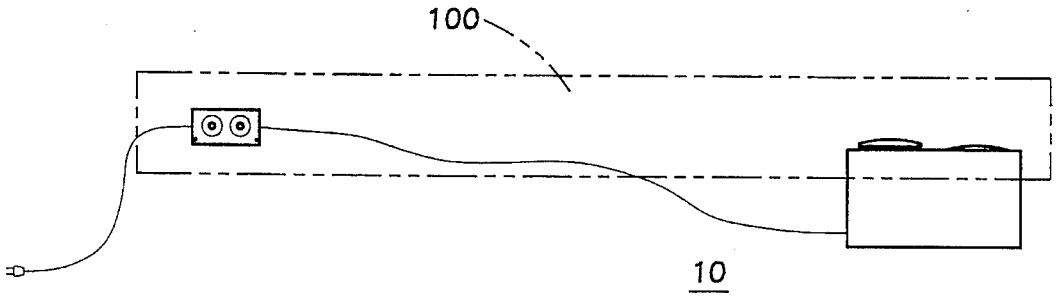
FIG. 3 is a side elevational view of FIG. 2.

Referring initially to FIG. 1, there is shown an a wave generating device generally designated by the reference numeral 10. Device 10 includes a housing 12 having top 14, side 16 and bottom 17 walls. Housing 12 should be fabricated from lightweight but sturdy material, such as sheet metal or aluminum, in order to secure the moving parts therein. A number of throughgoing boltholes 18 are located along the the top wall 14 of the housing 12 for facilitating attachment to the underside of a waterbed, as will be explained in greater detail in the following paragraphs.

Also depicted in FIG. 1 is the control panel 20 which includes a pair of control knobs 22, 24 and a pair of electrical reset buttons 26, 28, the function of which will also be explained in greater detail. In addition there is electrical wiring 30 (along with an associated male plug 32) which connects the control panel 20 to the housing 12.

Figure 4:
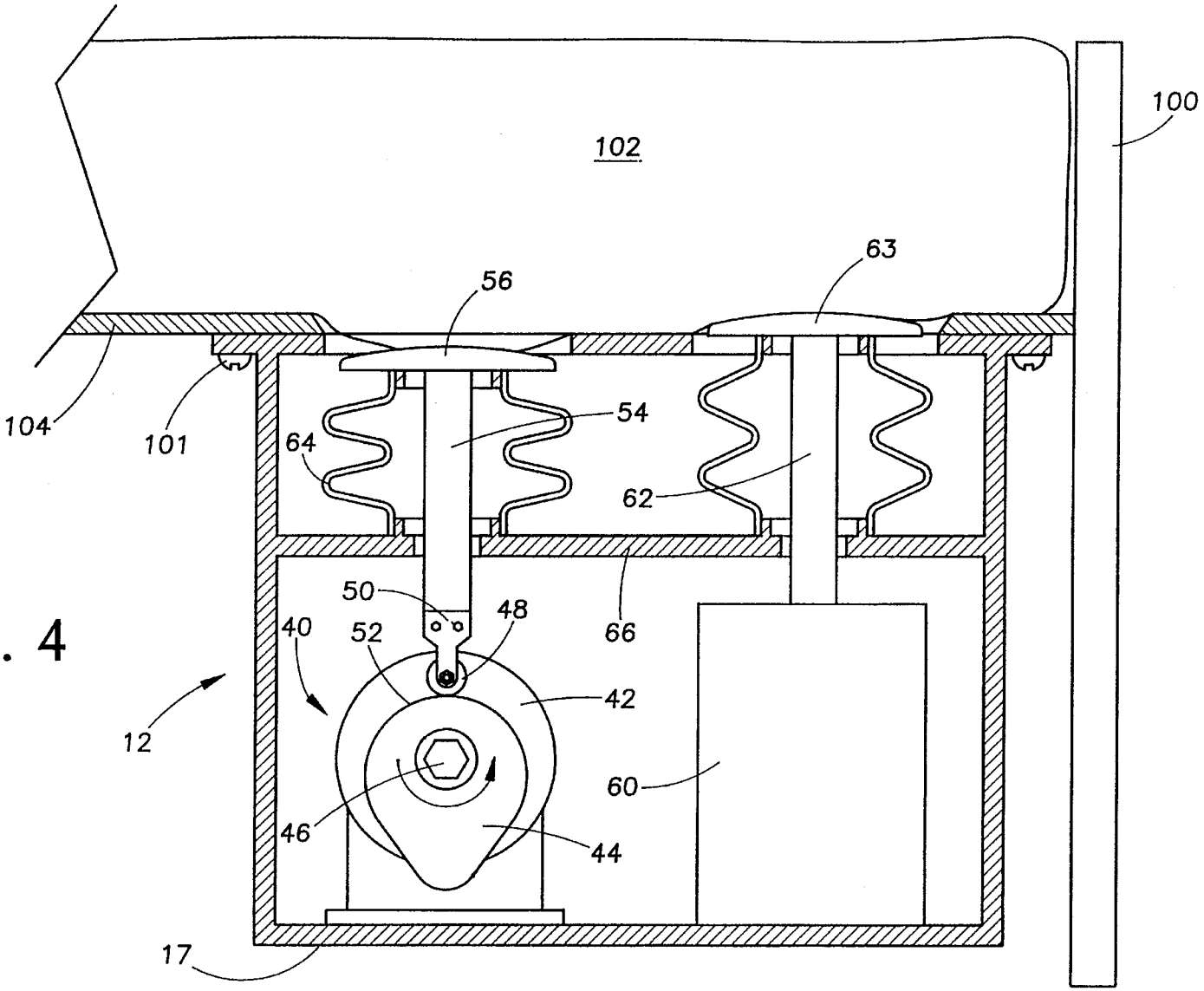
FIG. 4 is a side sectional view of the housing attached to the bottom of the mattress support platform, particularly illustrating the undulating mechanism in a lowered position.
Figure 5:
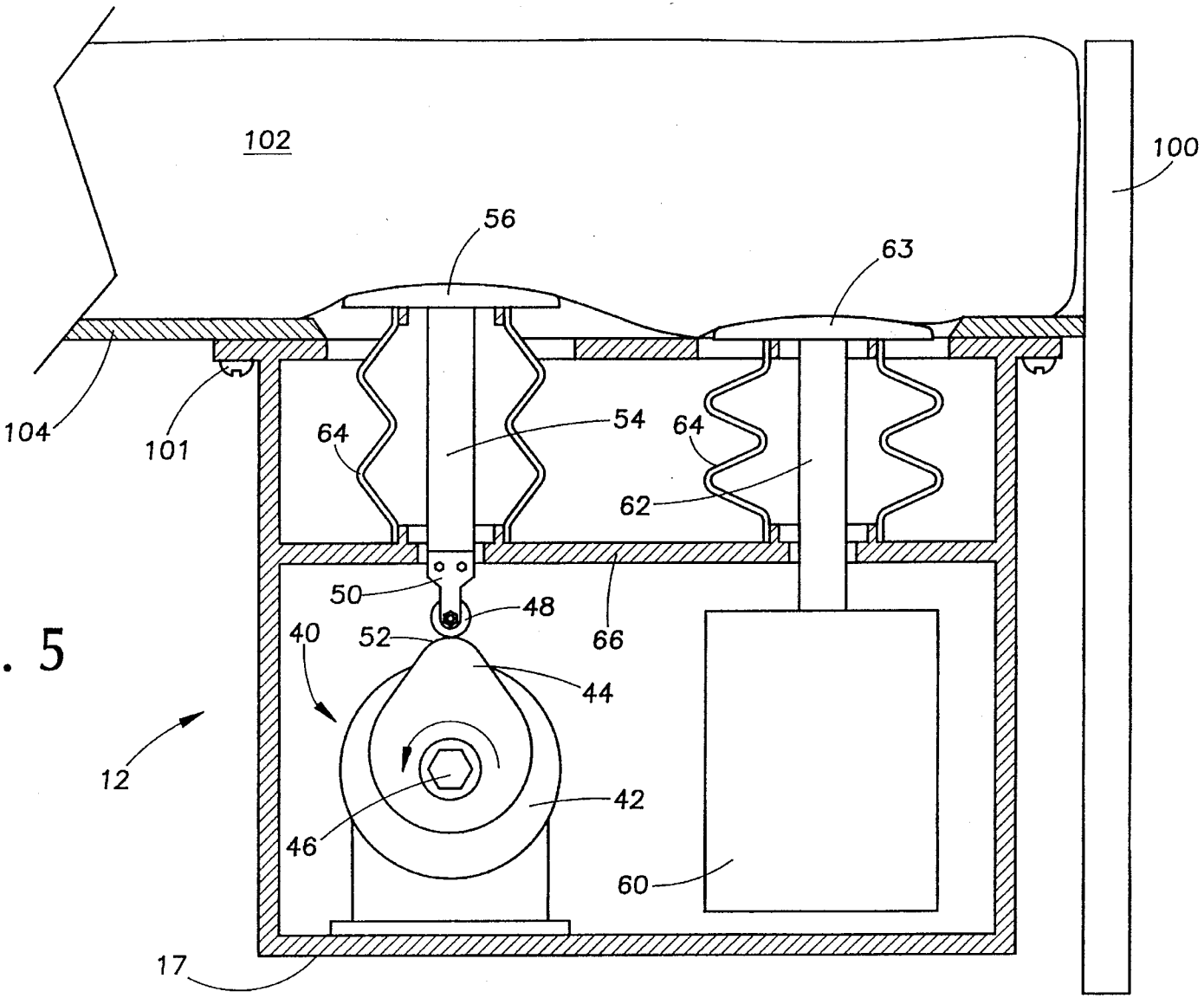
FIG. 5 is a side sectional view of the housing attached to the bottom of the mattress support platform, particularly illustrating the undulating mechanism in a raised position.

Referring now to FIGS. 4 and 5, the housing 12 of the wave generating device 10 is shown (in cross section) attached to the frame 100 of an ordinary waterbed through bolts, as at 101. The waterbed includes a water filled mattress 102 which rests on a horizontal platform 104, the platform being part of the supporting structure of the bed frame 100. Normally the platform 104 consists of a unitary sheet of solid material such as pine or oak; however a generally rectangular cutout section within the platform 104 is required to practice the present invention, as a portion of the mattress 102 must be in direct contact with the top 14 of the housing 12.

The wave generating device 10 has two main wave generating components. First, there is a undulation mechanism 40 which includes an electric motor 42 secured to the bottom wall 17 of the housing 12. An eccentric camming member 44 is connected to the output shaft 46 of the motor 42. In addition, a guide wheel 48 is secured by a yoke 50 and rides along the outer edge 52 of the camming member 44 in a generally elliptic path as the camming member 44 is caused to rotate by the motor shaft 46. Also included in the undulation mechanism 40 is a first rod member 54 attached at one end to the yoke 50. A first convex shaped agitation pad 56 is connected to the other end of the first rod 54 and is in direct contact with the mattress 102. It can thus be seen how a first type of wave motion is generated on the mattress 102 when the motor 42 is energized: as the camming member 44 is rotated to the position shown in FIG. 5, the first rod 54 and first agitation pad 56 are lifted vertically, thereby creating an upward force on the mattress 102. As the camming member 44 is further rotated to its original position shown in FIG. 4, the first rod 54 and pad 56 are once again lowered. The frequency of the reciprocating motion of the undulation mechanism 40 is controlled by the speed of the motor 42, which is adjustably controlled by knob 22.

Preferably, the first agitation pad 56 is constructed from molded plastic or other suitable,material resistant to surface burrs which may adversely affect the watertight integrity of the mattress 102, since the pad 56, in operation, produces a repeated upward force thereon.

The second wave generating component is a vibration mechanism 60 having a second rod member 62 and second agitation pad 63, each being identical to the first rod member 54 and the first agitation pad 56, respectively. In this case, however, the wave producing motion is not an upwardly directed force, but laterally directed forces on the mattress 102 generated by the side to side movement of the rod and agitation pad. This type of movement can be created by any ordinary vibration device operated within electric motor, such as those found in typical foot massaging devices. In a similar manner, the frequency of the vibration mechanism 40 is selectively controlled by hob 24.

Both of the first and second agitation pads 56, 63 are surounded by a pair of laterally spaced, rubber baffle members 64 which are attached at one end to the underside of the pads 56, 63 and at the other end to a horizontally disposed stanchion 66 within the housing 12. The baffle members 64 are used to prevent the entrance of moisture into the undulation and vibration mechanisms 40, 60, in the event of a mattress leak.

Finally, a pair of electrical reset buttons 26, 28 are provided to cut electrical power to each of the motors within the housing to prevent potential hazards such as water leakage or overheating of the motors.

It will thus be seen that the objects set forth above, among those elucidated in, or made apparent from, the preceding description, are efficiently attained. Since certain changes may be made in the above construction without departing from the scope of the invention, it is intended that all matter contained in the above description or shown on the accompanying drawing shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. A wave generating device for waterbeds, comprising:

a liquid filled mattress resting on a frame;

a bottom surface on the mattress;

an undulation means for producing a first wave motion on the mattress, the undulating means producing repetitive, upward force which is orthogonal to the bottom surface of the mattress;

a vibration means for producing a second wave motion on the mattress, the vibration means producing repetitive, lateral force which is substantially parallel the bottom surface of the mattress;

a control means for adjustably controlling the frequency of both the undulation and vibration means;

a housing means for containing the undulation means and the vibration means;

a mattress supporting platform;

an underside surface on the mattress supporting platform;

a securing means for attaching the housing means to an the underside surface;

a power source; and a wiring means for electrically connecting the power source to the wiring means.

2. The wave generating device as described in claim 1, wherein the undulation means further comprises:

an electric motor stationed within the housing means;

an output shaft on the electric motor;

an eccentric camming member connected to the output shaft;

an outer edge on the camming member;

a guide wheel in rolling contact with the outer edge;

a first rod mechanism attached at one end to the guide wheel; and a first agitation pad attached to another end of the first rod mechanism, the first agitation pad in intimate abutment with the underside of the mattress.

3. The wave generating device as described in claim 1, wherein the vibration means further comprises:

a vibration producing mechanism stationed within the housing means;

a second rod mechanism attached at one end to the vibration producing mechanism; and a second agitation pad attached to another of the second rod mechanism, the second agitation pad in intimate abutment with the underside of the mattress.

4. A wave generating device for waterbeds, comprising:

a liquid filled mattress resting on a frame;

a bottom surface on the mattress;

a mattress supporting platform;

an underside surface on the mattress supporting platform;

a housing having top, bottom, and side walls, the housing being securely fastened to the underside surface;

an undulation means for producing a first wave motion on a mattress of the waterbed, further comprising:

an electric motor stationed within the housing;

an output shaft on the electric motor;

an eccentric camming member connected to the output shaft;

an outer edge on the camming member;

a guide wheel in rolling contact with the outer edge;

a first rod mechanism attached at one end to the guide wheel; and a first convex shaped agitation pad attached to another end of the first rod mechanism, the first agitation pad in intimate abutment with the underside of the mattress; and the first agitation pad producing a repetitive, upward force orthogonal to the bottom surface of the mattress;

a vibration means for producing a second wave motion on the mattress of the waterbed, further comprising:

a vibration producing mechanism secured to the bottom wall of the housing;

a second rod mechanism attached at one end to the vibration producing mechanism; and a second convex shaped agitation pad attached to another end of the second rod mechanism, the second agitation pad in intimate abutment with the underside of the mattress; and the second agitation pad producing a repetitive, lateral force which is substantially parallel the bottom surface of the mattress;

a control panel for adjustably controlling the frequency of the undulation means and the vibration means, including a pair of control knobs each having a plurality of settings; and electrical wiring which connects the control panel to the housing.

5. The wave generating device as described in claim 4, further comprising a pair of laterally spaced, rubber baffle members, each having an upper end attached to the agitation pads and a lower end attached to a horizontal stanchion disposed within the housing.

6. The wave generating device as described in claim 5, wherein the control panel further comprises a pair of electrical reset buttons for cutting off electrical power to the housing.

7. The wave generating device as described in claim 4, wherein the control panel is attached to an outside surface of a side wall of the waterbed frame.

* * * * *